US010408234B2

(12) United States Patent
Onishi

(10) Patent No.: US 10,408,234 B2
(45) Date of Patent: Sep. 10, 2019

(54) MULTI-STAGE VACUUM EJECTOR

(71) Applicant: ONISHI TEKNIK AB, Brottby (SE)

(72) Inventor: Daniel Onishi, Brottby (SE)

(73) Assignee: ONISHI TEKNIK AB, Brottby (SE)

( * ) Notice: Subject to any disclaimer, the term of this patent is extended or adjusted under 35 U.S.C. 154(b) by 131 days.

(21) Appl. No.: 15/319,398

(22) PCT Filed: Jun. 22, 2015

(86) PCT No.: PCT/SE2015/000039

§ 371 (c)(1),
(2) Date: Dec. 16, 2016

(87) PCT Pub. No.: WO2015/199596

PCT Pub. Date: Dec. 30, 2015

(65) Prior Publication Data

US 2017/0152868 A1 Jun. 1, 2017

(30) Foreign Application Priority Data

Jun. 23, 2014 (SE) ..... 1400313

(51) Int. Cl.

| | |
|---|---|
| ***F04F 5/22*** | (2006.01) |
| ***F04F 5/26*** | (2006.01) |
| ***F04F 5/46*** | (2006.01) |
| ***F04F 5/52*** | (2006.01) |

(52) U.S. Cl.

CPC ..... *F04F 5/22* (2013.01); *F04F 5/26* (2013.01); *F04F 5/46* (2013.01); *F04F 5/52* (2013.01)

(58) Field of Classification Search

CPC ..... F04F 5/22; F04F 5/467; F04F 5/52

USPC ..... 417/166

See application file for complete search history.

(56) References Cited

U.S. PATENT DOCUMENTS

| | | | | |
|---|---|---|---|---|
| 4,696,625 | A | 9/1987 | Greenberg | |
| 6,582,199 | B1 * | 6/2003 | Volkmann | F04F 5/467 417/178 |
| 8,596,990 | B2 * | 12/2013 | Schaaf | F04F 5/22 417/151 |
| 2005/0061378 | A1 * | 3/2005 | Foret | F04F 5/04 137/888 |
| 2013/0167566 | A1 | 7/2013 | Alahyari | |
| 2015/0076249 | A1 * | 3/2015 | Kaupp | F04F 5/467 239/268 |

FOREIGN PATENT DOCUMENTS

| | | | |
|---|---|---|---|
| DE | 19808548 | A1 | 9/1999 |
| EP | 1452236 | A2 | 9/2004 |
| KR | 20130098036 | A | 9/2013 |

OTHER PUBLICATIONS

International Search Report (dated Oct. 14, 2015) for corresponding International App. PCT/SE2015/000039.

* cited by examiner

*Primary Examiner* — Patrick Hamo
(74) *Attorney, Agent, or Firm* — WRB-IP LLP

(57) ABSTRACT

A multi-stage ejector is provided for producing vacuums in an industrial process and includes at least two ejector units axially arranged at a predetermined distance apart in an ejector housing. Each of the at least two ejector units includes at least two parallelly arranged hollow feed-throughs for compressed air, including inlet and outlet nozzles and at least one hollow feed-through for vacuum. Each of the at least two ejector units is configured as a part produced from one piece.

6 Claims, 12 Drawing Sheets

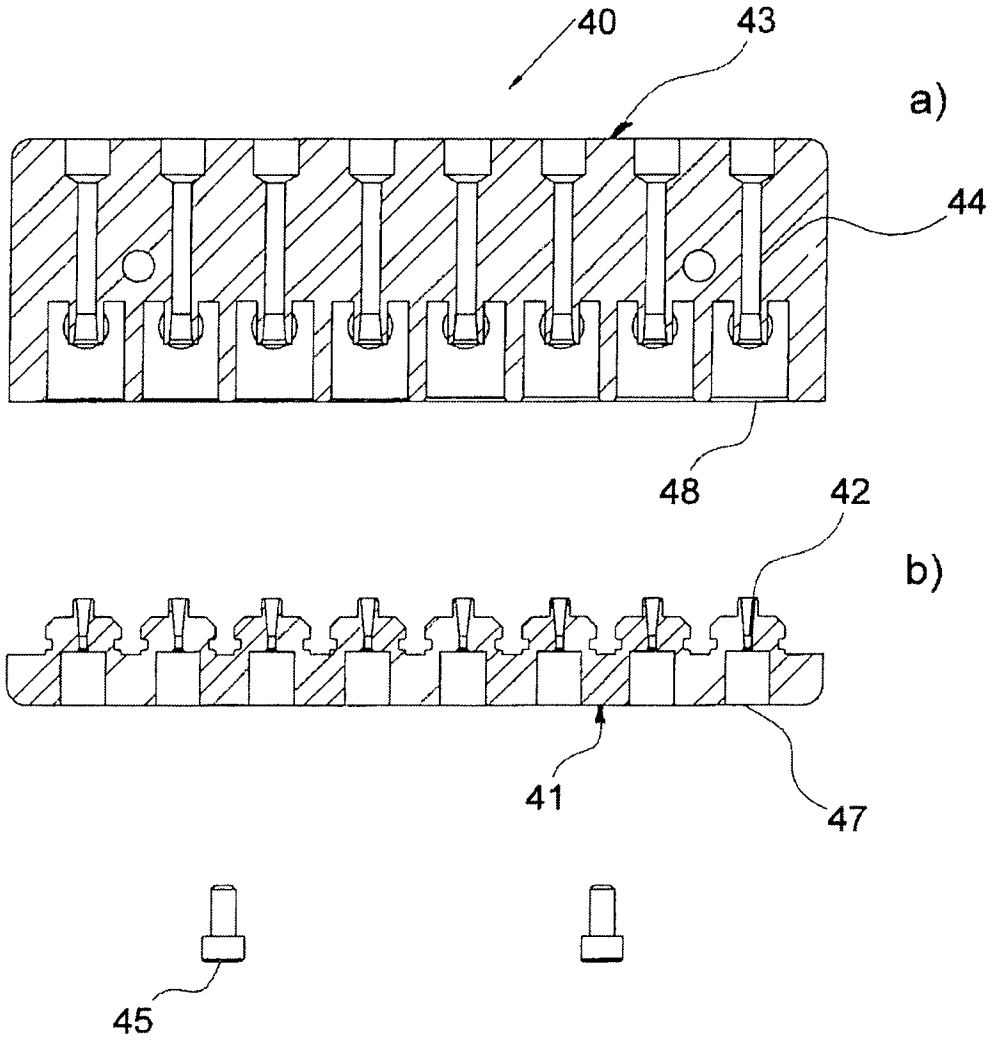
Fig.9 a-b

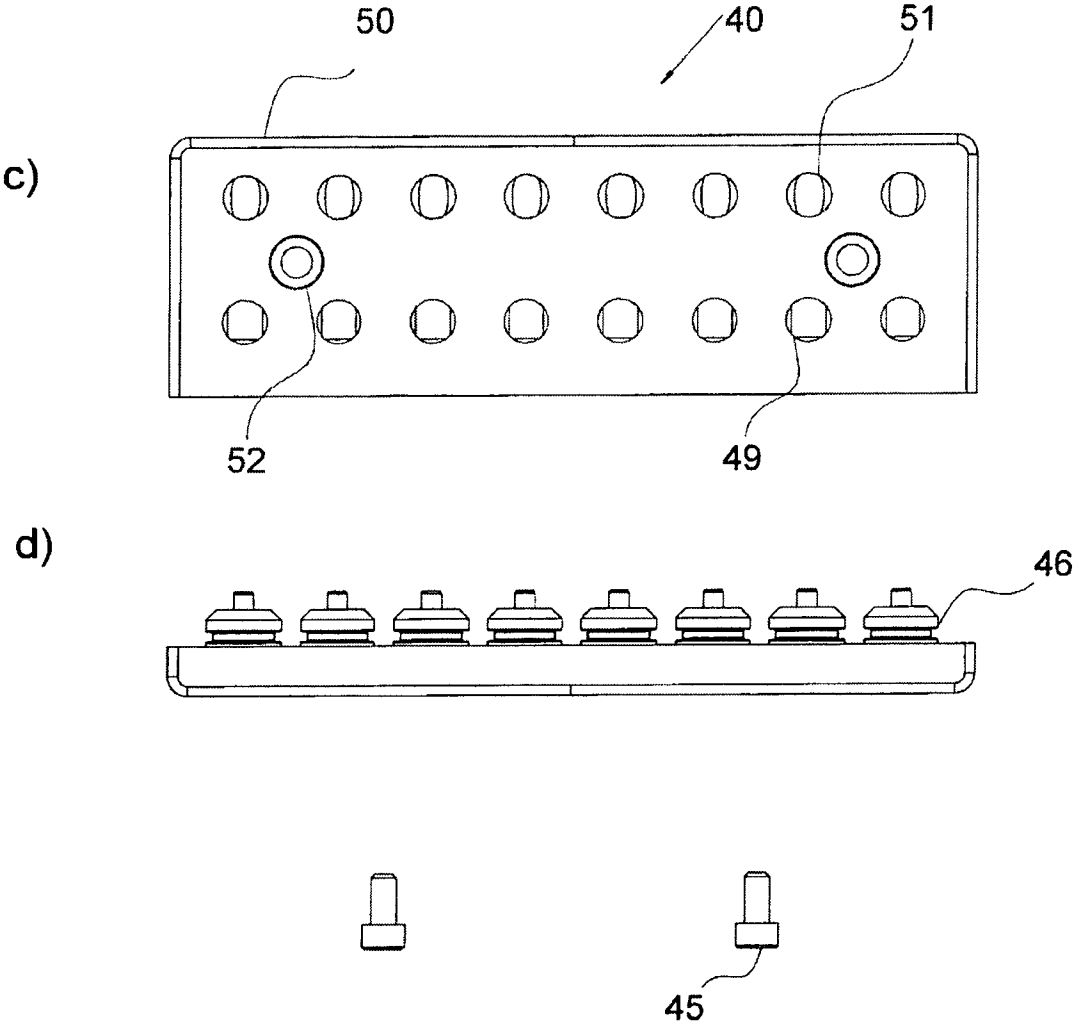
Fig.9 c-d

MULTI-STAGE VACUUM EJECTOR

BACKGROUND AND SUMMARY

The present invention relates to a vacuum ejector for producing vacuums in industrial processes. More specifically, the invention relates to a multi-stage vacuum ejector in which the ejector stages are arranged in series and/or in parallel.

A multi-stage ejector having a plurality of ejector stages arranged in series and/or in parallel has long been known.

Typical of a multi-stage ejector is that it comprises an ejector housing, comprising two or more ejector stages, also termed ejector units, axially arranged one after the other in series. In each of the ejector units there is arranged a compressed air duct comprising an ejector nozzle for producing the vacuum flow of the ejector and a vacuum duct for said vacuum flow. The ejector units are separated from one another via transverse partition walls disposed in the ejector housing.

Compressed air is fed to the multi-stage ejector via a hose coupling or pipe coupling disposed in the first ejector unit of the multi-stage ejector. After having passed through the first ejector unit, the compressed air is forwarded at high velocity into a second ejector unit and thereafter, possibly, onward to a third and fourth ejector unit. In the spaces between the ejector units, between the outlet of an ejector nozzle and the inlet of a following ejector nozzle is formed an underpressure, also termed a vacuum flow, the size of which is determined by factors such as incoming compressed air, the number of ejector units, the distance between the nozzles of the ejector units, and the configuration of the nozzles.

In GB 2262135A, FIGS. 1 and 2, is shown a multi-stage ejector in an ejector housing, comprising axially arranged ejector units separated from one another via transverse dividing planes disposed in the ejector housing, wherein the dividing planes comprise feed-throughs for compressed air ducts and vacuum ducts, in which the ejector nozzles and nonreturn valves, respectively, are mounted.

U.S. Pat. No. 4,696,625A, FIG. 2, shows a multi-stage ejector similar to that in GB 2262135A. The multi-stage ejector according to U.S. Pat. No. 4,696,625A, FIG. 2, differs by virtue of the fact that the ejector housing also comprises a longitudinal plane in which the vacuum feed-throughs with nonreturn valves are disposed.

Various ways of mounting ejector nozzles in the compressed air feed-throughs have been proposed, for example various types of fastening joints such as glue joints, screw joints, threaded joints or shrink joints.

A problem with said multi-stage ejectors is their configuration with many separate parts which have to be mounted, transverse and horizontal planes, separate ejector nozzles, etc., which implies an increased risk of malfunction in the ejector. A large number of parts also implies that the risk of error in the production of the ejector is high, resulting in a high rejection rate.

In the light of the above, there is a need for a simple multi-stage ejector having few component parts, which has high reliability and which is cheap and easy to produce.

It is desirable to provide a simplified multi-stage ejector having few component parts, having high reliability, and which is easy and cheap to produce.

It is also desirable to provide a multi-stage ejector which can be easily miniaturized for use within, for example, microelectromechanical systems (MEMS).

Thus, according to aspects of the present invention, a multi-stage ejector for producing a vacuum flow in an industrial process has been provided, comprising at least two ejector units axially arranged at a predefined distance apart in an ejector housing, wherein each of the at least two ejector units comprises at least two parallelly arranged hollow feed-throughs having inlet and outlet nozzles for a compressed air flow and at least one hollow feed-through for the vacuum flow.

Characteristic of the multi-stage ejector is that each of the at least two ejector units with the hollow feed-throughs for compressed air having inlet and outlet nozzles for a compressed air flow and at least one hollow feed-through for the vacuum flow.

According to further aspects of the multi-stage ejector:

the ejector units are positionable in the ejector housing, via longitudinal grooves disposed on the outer side of the ejector units and via corresponding longitudinal guide rails disposed on the inner side of the ejector housing, the ejector units are lockable via spring-pretensioned guide lugs on the inner side of the ejector housing and via corresponding recesses on the outer side of the ejector units, the ejector housing is configured as a cylinder, the first ejector unit and the third ejector unit comprise a sleeve coupling for connection to incoming and outgoing compressed air respectively, wherein the sleeve coupling comprises an outer sleeve, in which is mounted an inner sleeve, comprising a mounting seat for possible mounting of a nonreturn valve and a filter, the sleeve coupling comprises transverse spring-loaded locking pins for locking the sleeve coupling to the respective ejector unit.

The invention, according to aspects thereof, implies a number of advantages and effects, the most important being; simple design with few parts, with high reliability, which is easy to produce and fault-localize.

The invention, according to aspects thereof, also enables substantial miniaturization, for application to, for example, MEMS.

The invention, according to aspects thereof, also implies a simplified production process resulting in large cost benefits.

The invention, according to aspects thereof, has been defined in the following patent claims and shall now be described in somewhat greater detail in connection with the appended figures.

BRIEF DESCRIPTION OF THE DRAWINGS

Further advantages and effects will emerge from study and consideration of the following, detailed description of the invention, with simultaneous reference to the appended drawing figure in which:

FIGS. 9 *a-f* show in schematic representation a plate-shaped single-stage ejector of rectangular cross section, comprising an ejector unit having eight parallelly arranged ejector nozzles;

DETAILED DESCRIPTION

Figure 2:
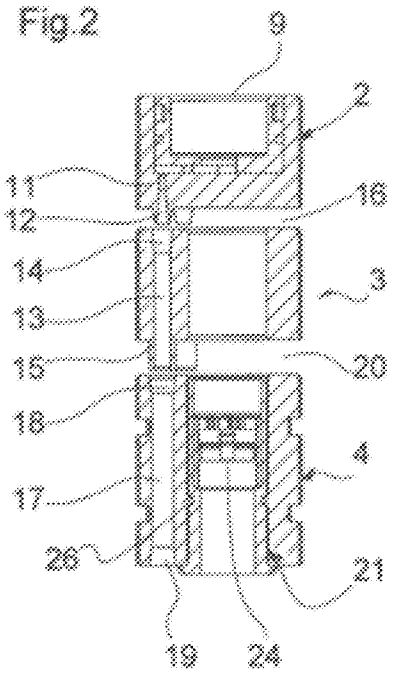
FIG. 2 shows a longitudinal section of a multi-stage ejector taken at section 2-2 of FIG. 1.

In FIGS. 1-4 is shown a preferred embodiment of a multistage ejector 1 according to the invention, realized in the form of an ejector pump. The ejector pump, FIGS. 1 and 2, comprises three ejector units 2,3,4, arranged axially one after the other; a first ejector unit 2, comprising a first compressed air connection 9 for connection to incoming compressed air, for example via a compressed air hose, a second, intermediate ejector unit 3, and a third ejector unit 4, comprising a second compressed air connection 21 for connection to outgoing compressed air, for example via a compressed air hose.

The ejector pump has preferably a cylindrical shape, but can also have a different shape of, for example, square or rectangular cross section. The ejector pump is preferably accommodated in an ejector housing 5, FIG. 4, having a configuration corresponding to the shape, for example cylindrical shape, of the ejector pump.

In an alternative embodiment (not shown), the ejector housing can also comprise detachable end walls having feed-throughs for compressed air connections.

In a further special embodiment (not shown), the ejector housing is constituted by short cylindrical sleeves, arranged between and coupled to the three ejector units 2,3,4. The length of the sleeves equates to the space between the ejector units 2,3,4. The advantages with the sleeve arrangement are, above all, that the multi-stage ejector can be made smaller, lighter and more flexible since an ejector unit can be easily exchanged by the release of a sleeve.

The three ejector units 2,3,4 are axially and radially positionable and lockable relative to one another in the ejector housing 5, via a plurality of spring-pretensioned guide lugs disposed on the inner side of the ejector housing 5 and via recesses disposed on the ejector units 2,3,4 and corresponding to the guide lugs. The guide lugs can advantageously be disposed on guide rails running longitudinally inside the ejector.

Alternatively, the ejector units 2,3,4 can be positionable relative to one another in the ejector housing 5, via grooves 6 running longitudinally on the ejector units 2,3,4 and via corresponding guide rails 7 on the inner wall of the ejector housing 5.

The ejector units 2-4 positionable in the ejector housing 5 are also lockable in defined positions, via locking devices 8 which are disposed in the ejector housing 5 and which, for example, can be constituted by radially arranged locking pins or alternatively by locking or clamping screws.

Apart from hollow feed-throughs for compressed air 11,13,17, the second and the third ejector unit 3,4 in the axial direction comprises hollow feed-throughs for vacuum, also termed vacuum feed-throughs 16,20. In the spaces between the first and the second ejector unit 2,3 and between the second and the third ejector unit 3,4 (the suction side of the ejector pump), the vacuum flow of the ejector pump 1 arises.

The vacuum flow depends on factors such as the pressure of the incoming compressed air, the number of ejector units, the distance between the ejector units, and the configuration of the ejector nozzles. In one embodiment, the vacuum flow of the ejector is regulated by regulating the distance between the ejector units 2,3,4.

Figure 6:
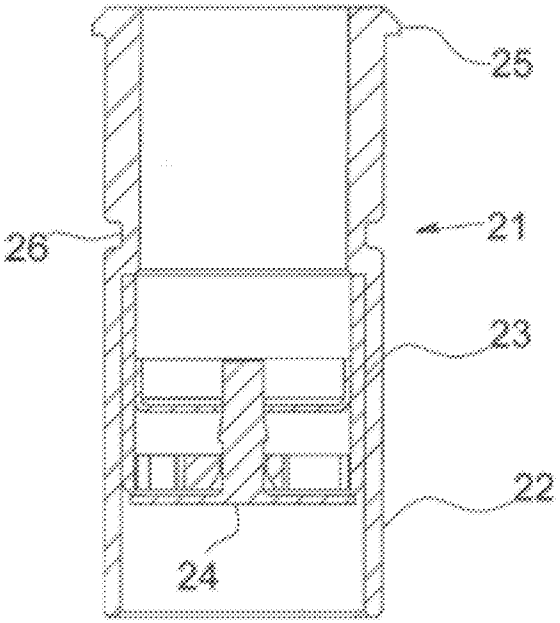
FIG. 6 shows a longitudinal section of the sleeve coupling taken at section 6-6 of FIG. 5.
Figure 5:
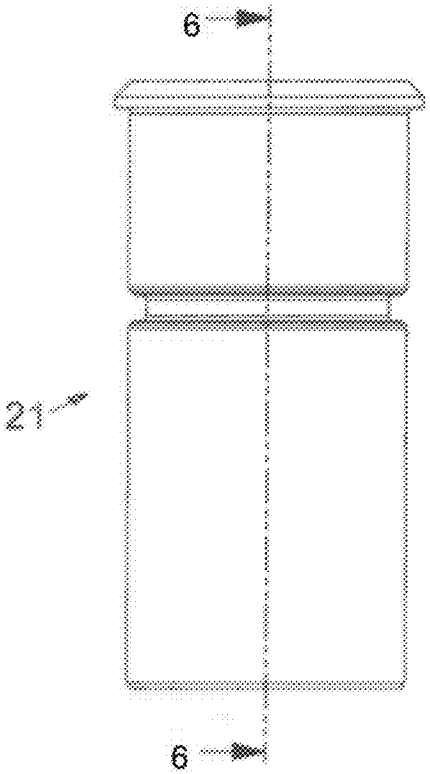
FIG. 5 shows a detailed view of a coupling sleeve according to FIG. 1, in which the placement of the nonreturn valve in the coupling sleeve can be seen.

As can be seen from FIG. 2, the first and the third ejector unit 3,4 also each comprise a coupling device for connection to incoming and outgoing compressed air, respectively, for the multi-stage ejector. To this end, a flexible sleeve coupling 21, FIGS. 5 and 6, has been developed. The sleeve coupling 21, which comprises a swiveling part, can be used both on the suction and on the pressure side of the ejector. In FIGS. 5 and 6 is shown the sleeve coupling 21, though only mounted on the ejector unit 4 for outgoing compressed air. The sleeve coupling 21 comprises an outer sleeve 22, in which an inner sleeve 23 is mounted. In the inner sleeve 23 there is arranged a seat for mounting of a nonreturn valve 24 and of a filter 25. Nonreturn valve or filter functions or both can be easily installed and changed according to requirement. For mounting of the sleeve coupling 21 in an ejector unit 2,4, the sleeve coupling 21 also comprises a supporting flange 25 and a bearing seat 26.

The sleeve coupling is locked with transverse, spring-loaded locking pins. The swiveling part can be variously configured, with different types of threads, plug-in couplings or pipe branches. The whole of the sleeve coupling 21 with pressure connection can be easily changed by removing the transverse locking pins.

Figure 1:
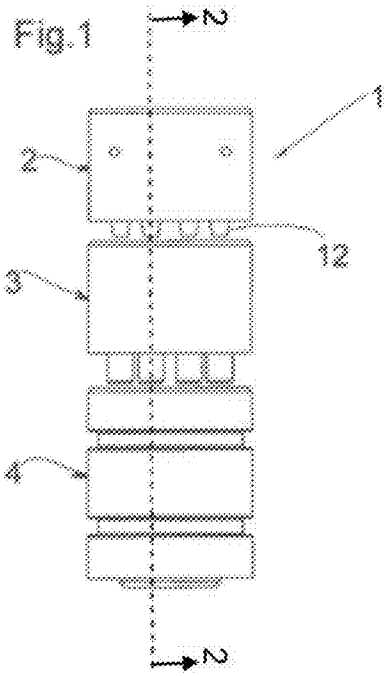
FIG. 1 shows in schematic representation an overall view of a multi-stage-ejector, configured as a vacuum pump, comprising three ejector units arranged axially one after the other, a first ejector unit comprising a coupling sleeve for connection to incoming compressed air, a second, intermediate ejector unit, and a third ejector unit comprising a coupling sleeve and a nonreturn valve for connection to outgoing compressed air.
Figure 4:
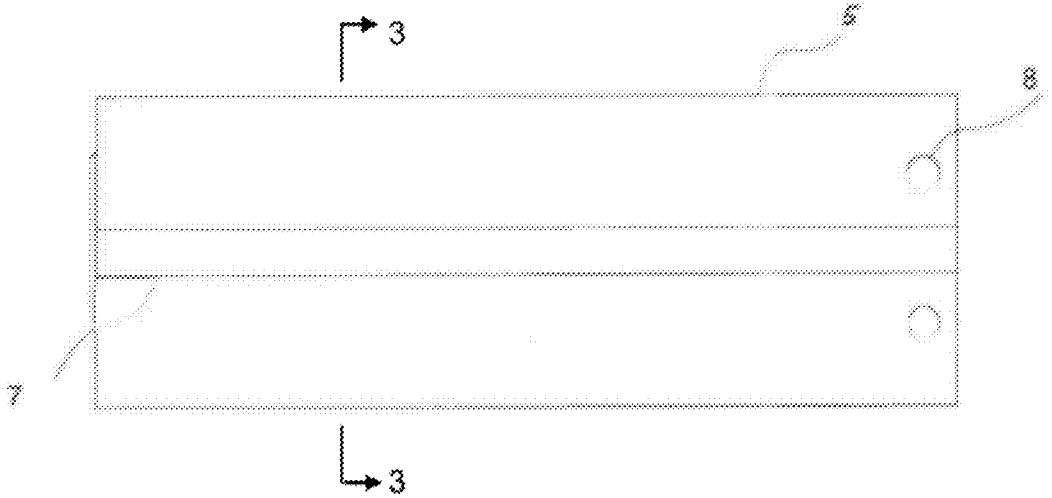
FIG. 4 shows a cylindrical ejector housing intended for a multi-stage ejector according to FIG. 1.
Figure 3:
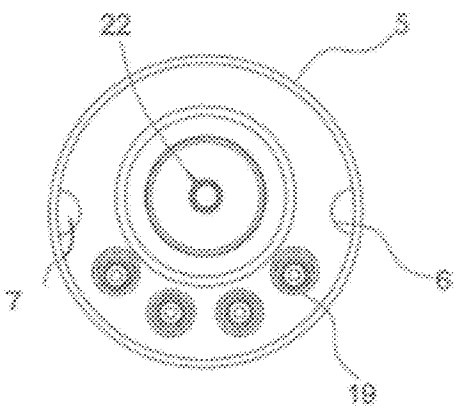
FIG. 3 shows a cross section of a multi-stage ejector taken at section 3-3 of FIG. 4, in which the compressed air duct for outgoing compressed air and the vacuum duct for inbound vacuum flow can be seen.

In the preferred embodiment of the multi-stage ejector, FIGS. 1 and 2, each of the three ejector units 2,3,4 comprises four parallelly arranged compressed air feed-throughs 19, distributed in a semicircular shape on one half of the ejector units 2,3,4. In the first ejector unit 2, the four compressed air feed-throughs 11 extend approximately halfway through the ejector unit 2, where it connects to the coupling device 9 for connection to inbound compressed air.

In the second ejector unit 3, as in the third ejector unit 4, the compressed air feed-throughs 13, 17 are continuous from one end wall to the other end wall. The compressed air feed-throughs 11,13,17 further comprise aerodynamically configured inlet pieces and nozzles 14,18 and outlet nozzles 12,15,19.

Furthermore, the ejector units 2,3 and 4 are positioned at a defined distance apart, so that the outlet nozzle 12 of the first ejector unit 2 connects to the inlet nozzle 14 of the second ejector unit 3 and the outlet nozzle 15 of the second ejector unit 3 connects to the inlet nozzle 18 of the third ejector unit 3.

The ejector units 2,3,4 with hollow feed-throughs for compressed air and vacuum and associated inlet and outlet nozzles are each configured as a single pan and produced from a single piece. Production of the ejector units 2,3,4 is effected preferably, with the aid of the prior art, via mechanical machining from a metal piece. Alternatively, for example for use in MEMS applications, the production can also be effected via a pressing or molding operation, wherein plastics or composite material can also be used.

Figure 7:
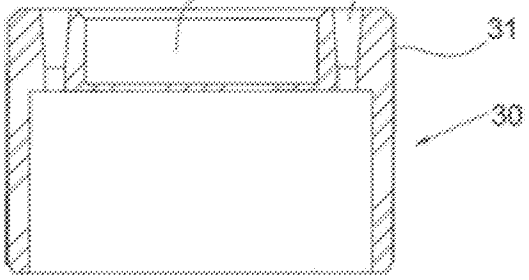
FIG. 7 shows a section of the ejector unit of FIG. 8 taken at section 7-7.
Figure 8:
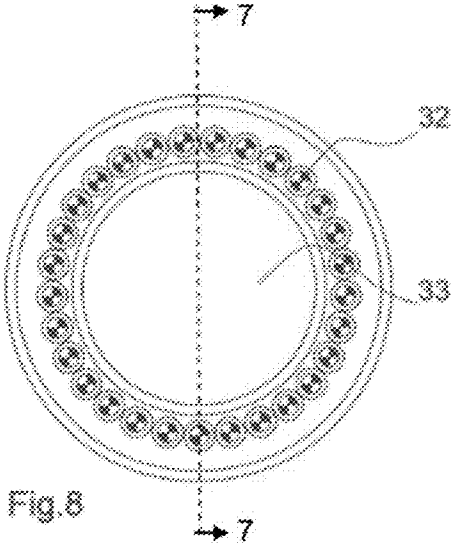
FIG. 8 shows an alternative embodiment of an ejector unit according to FIG. 1, in which the hollow feed-through for the vacuum flow is arranged centrally in the ejector unit and in which the hollow feed-throughs for compressed air are evenly distributed around the centrally positioned vacuum duct.

Alternative embodiments regarding the number of compressed air feed-throughs and their distribution are possible. FIGS. 7 and 8 show an alternative embodiment of an ejector unit 30, in which a hollow feed-through for the vacuum flow 33 is arranged centrally in the ejector unit 30 and in which the hollow feed-throughs 32 for compressed air are evenly distributed around the centrally positioned vacuum duct 33.

FIGS. 9-15 show some alternative embodiments of plate-shaped single-stage or multi-stage ejectors of square or rectangular cross section.

FIGS. 9 *a*-*b* show a longitudinal section of a plate-shaped single-stage ejector 40 of rectangular cross section. The single-stage ejector 40 comprises two ejector units, each produced from one piece, a first ejector unit 41 comprising eight ejector nozzles 42, arranged side by side in parallel, corresponding to previously described inlet and outlet nozzles with intermediate compressed air duct, a second ejector unit 43 comprising eight parallelly arranged ejector nozzles 44. The two ejector units 41,43 are coupled and joined together to each other via screws 45 or rivets, FIGS. 9 *b, d*. Other coupling or joining methods too can be used, such as, for example, tacks or glue. The two ejector units 41,43 are sealed, preferably with the aid of elastic sealing rings 46, FIG. 9*d*, such as, for example, O-rings, which are applied to the flange-like protruding parts of the ejector nozzles 42 of the ejector units, FIG. 9 *d*. Alternative sealing means, such as glue, are also used.

The compressed air inlet 47 of the first ejector unit 41 is configured for a compressed air connection, preferably in the form of a rotating or threaded coupling, alternatively a swiveling lock coupling. The compressed air outlet 48 of the second ejector unit 43 is preferably configured for connection to a sound damper or a hose.

Between the first ejector unit 41 and the second ejector unit 43 are arranged vacuum ducts to the inlets of the ejector nozzles 44 in the second ejector unit 43. The vacuum ducts are connected to eight corresponding vacuum ports 49 disposed in a connecting plate 50 mounted on the top side of the second ejector unit 43, FIG. 9 *a*. On the connecting plate 50 are further arranged eight vacuum detection ports 51 connected to the compressed air outlets 48 in the ejector nozzles 44 of the second ejector unit 43, FIG. 9 *a*. The vacuum detection ports 51 detect and register the vacuum pressure in the ejector 40 and regulate, via switching on and off of a control valve (not shown), the vacuum flow of the ejector 40. On the connecting plate 50 are also arranged fastening or connecting devices 52, for example in the form of hollow feed-throughs, for mounting of the ejector 40 on an external unit, for example a vacuum tube.

Figure 10:
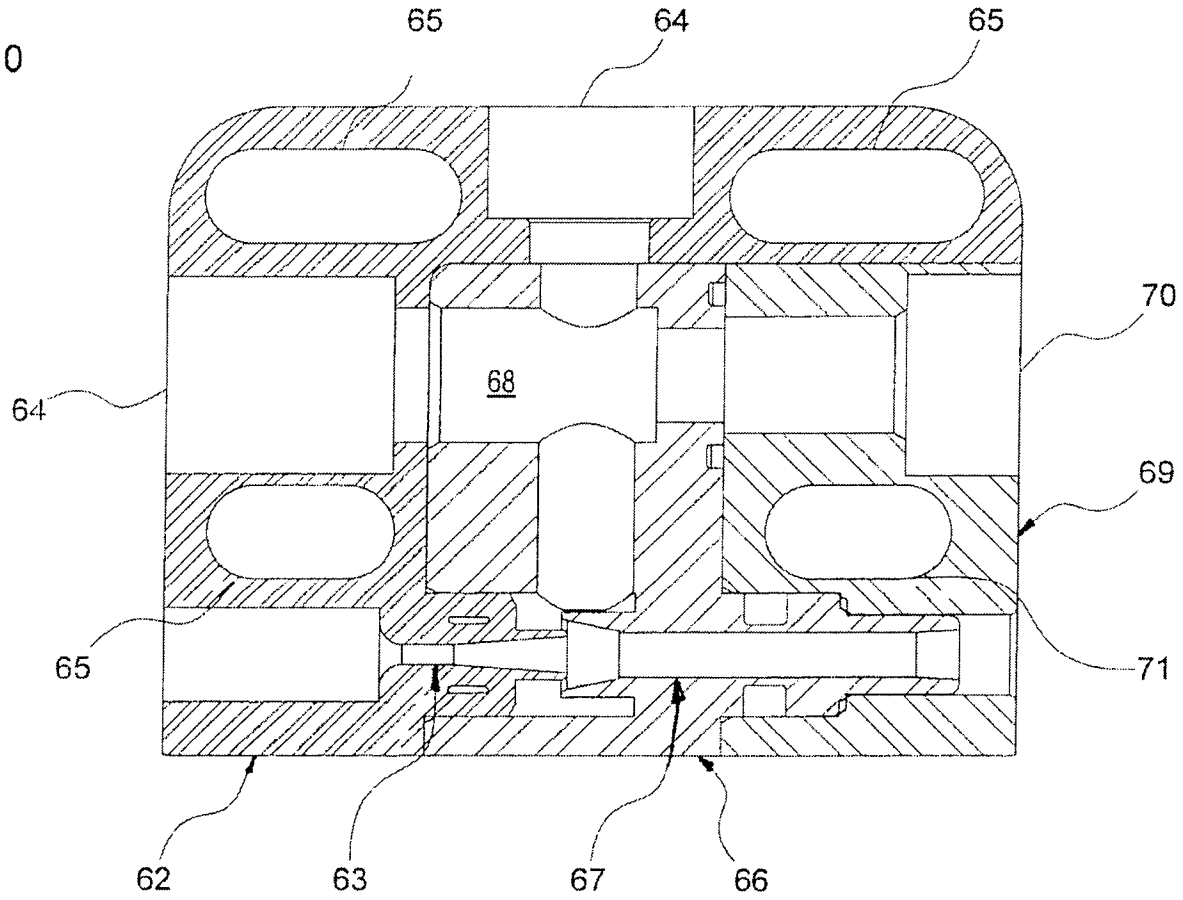
FIG. 10 shows in schematic representation a modular single-stage ejector having two ejector units.
Figure 11:
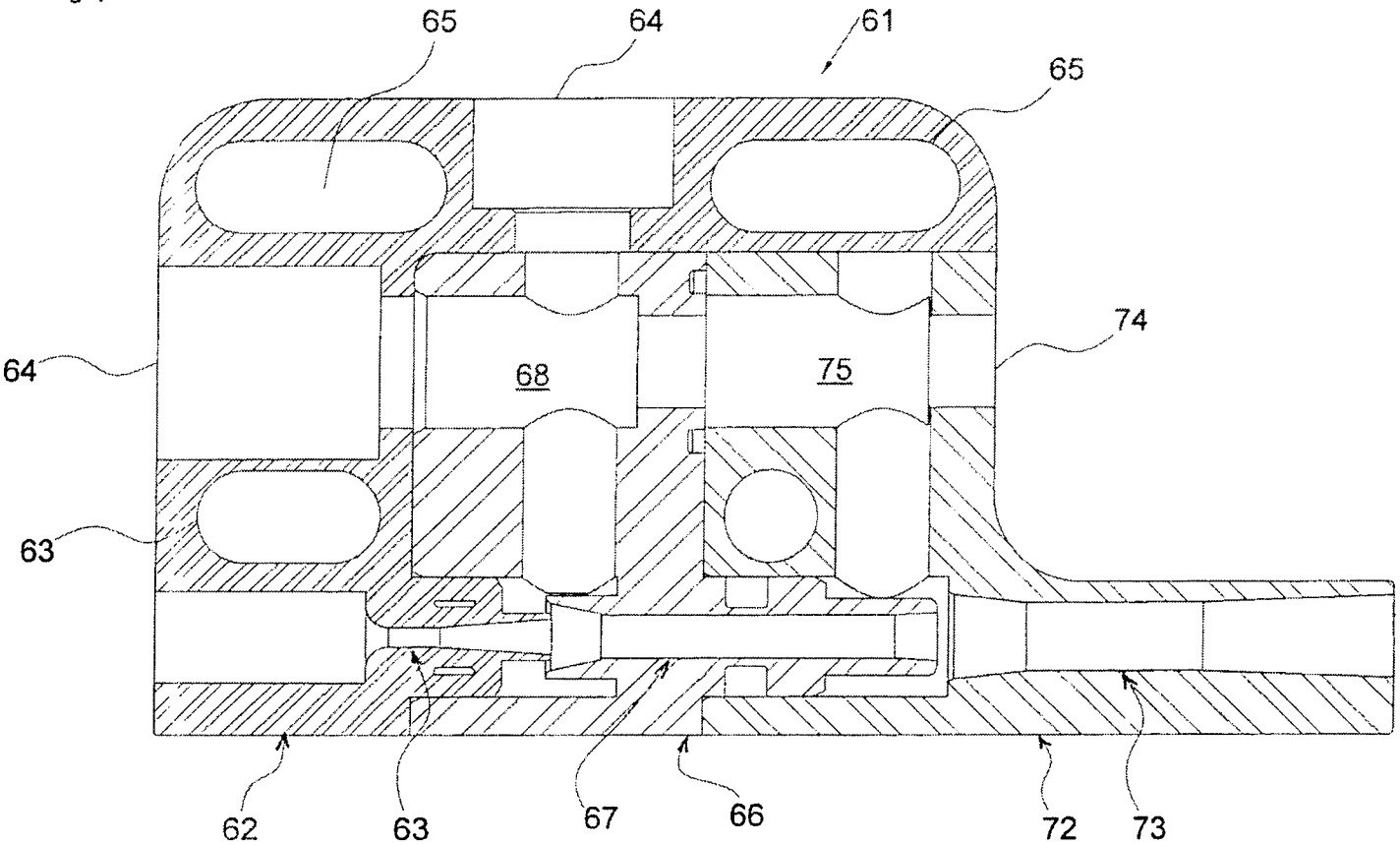
FIG. 11 shows in schematic representation a modular two-stage ejector having three ejector units.

FIGS. 10 and 11 show a modular ejector arranged for simple conversion from a single-stage ejector 60 to a two-stage ejector 61, and vice versa, wherein the modular ejector comprises two base or basic elements and two exchangeable elements, wherein each of the four elements is realized/produced in one piece. The first basic element 62 comprises a first ejector unit 63, two vacuum ports 64 and three mounting holes 65. The second basic element 66 comprises a second ejector unit 67 and a first vacuum duct 68.

The first exchangeable element 69, which constitutes an end piece for a single-stage ejector, comprises a third vacuum port 70 and a fourth mounting hole 71. The second exchangeable element 72, FIG. 11, which constitutes an end piece for a two-stage ejector, comprises a third ejector unit 73 and a fourth vacuum port 74, which is connected to a second vacuum duct 75 with connection to the first vacuum duct 68.

FIG. 10 shows the modular ejector realized as a single-stage ejector 60, comprising the two basic elements 62,66 and the first exchangeable element 69. FIG. 11 shows a modular ejector realized as a two-stage ejector 66, comprising the two basic elements 62,66 and the second exchangeable element 72. When the end piece is mounted in the single-stage or two-stage ejector, the basic elements and the end piece are locked together and form a coherent unit. The end pieces are locked preferably via screws or rivets 76.

Figure 12:
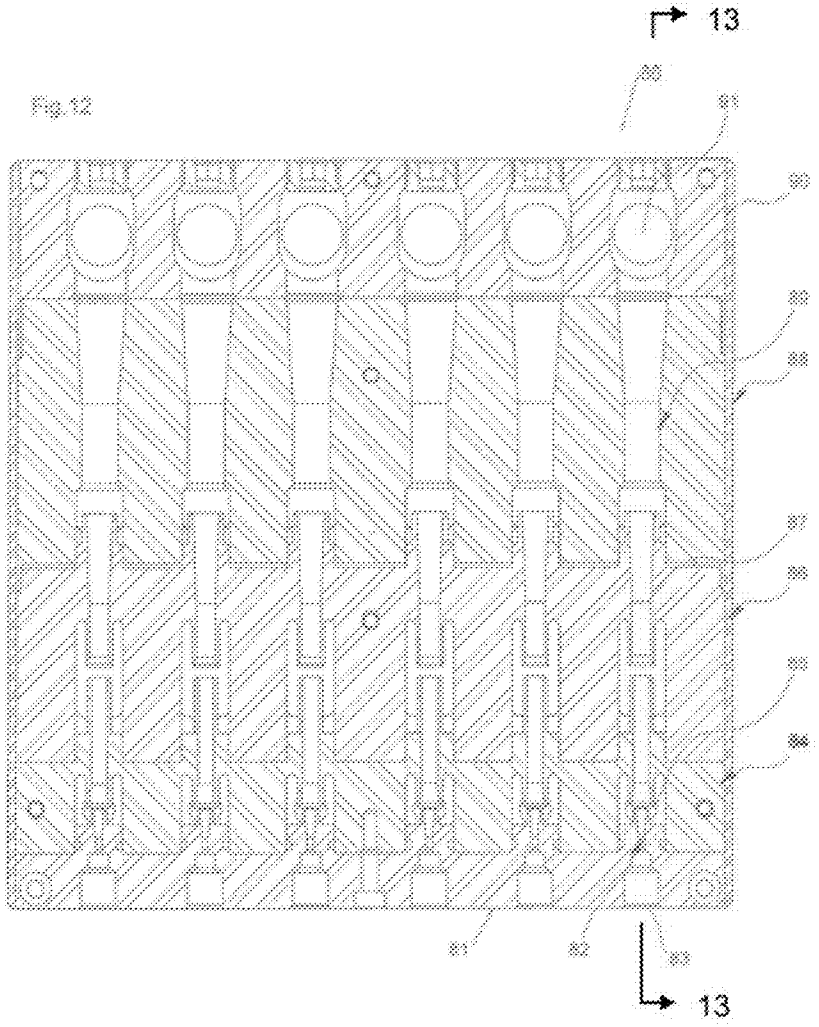
FIG. 12 shows in schematic representation a cross section taken at section 12-12 of FIG. 13 of a plate-shaped three-stage ejector of rectangular cross section comprising four, axially coupled ejector units.
Figure 13:
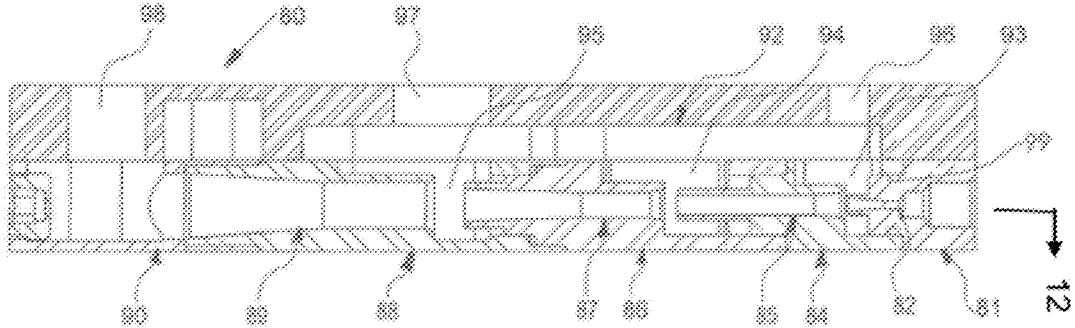
FIG. 13 shows a cross section of a three-stage ejector taken at section 13-13 of FIG. 12.

FIGS. 12 and 13 show a longitudinal section and cross section, respectively, of a plate-shaped three-stage ejector 80 of rectangular cross section. The three-stage ejector 80 comprises four, in the axial direction, serially coupled ejector units, each produced from one piece, a first ejector unit 81, comprising six, in the radial direction, parallelly arranged ejector nozzles 82, corresponding to the previously described inlet and outlet nozzles with intermediate compressed air duct, with hollow feed-throughs 83 for incoming compressed air, a second ejector unit 84 comprising six parallelly arranged ejector nozzles 85 corresponding to the first ejector stage of the three-stage ejector 80, a third ejector unit 86 comprising six parallelly arranged ejector nozzles 87 corresponding to the second ejector stage of the three-stage ejector 80, a fourth ejector unit 88 comprising six parallelly arranged ejector nozzles 89 corresponding to the third ejector stage of the multi-stage ejector 80, and a concluding closure piece or end piece 90 comprising vertically arranged outlet holes 91 for outgoing compressed air.

The three-stage ejector 80, according to FIG. 13, further comprises a, in the axial direction, continuous vacuum duct 92, FIG. 13, comprising vertical vacuum connections, a first vacuum connection 93, a second vacuum connection 94 and a third vacuum connection 95 to the pressure inlets of the second, third and fourth ejector unit 84,86,88.

The common vacuum duct 92 further comprises three, in the opposite direction, vertical ducts connected to a connecting plate 95 on the top side of the ejector, a rear vacuum duct 96, in the form of a vacuum detector, and a front vacuum duct 97, as well as a front compressed air duct 98 for outgoing compressed air.

On the connecting plate 92 are also arranged mounting or joining devices 99 for fitting of the three-stage ejector 80 to an external unit or for mounting/joining of two or more, parallelly stacked three-stage-ejectors 80. The mounting or joining devices 99 can be constituted by screws, a screw joint, or by snap fastenings, but other joining devices can also be used, such as, for example, glue joints.

The connecting plate 92 can be variously configured and can also comprise fastening devices for connecting one or more multi-stage ejectors to various external units, such as, for example, a pipeline for generation of vacuum in an industrial process.

Figure 14:
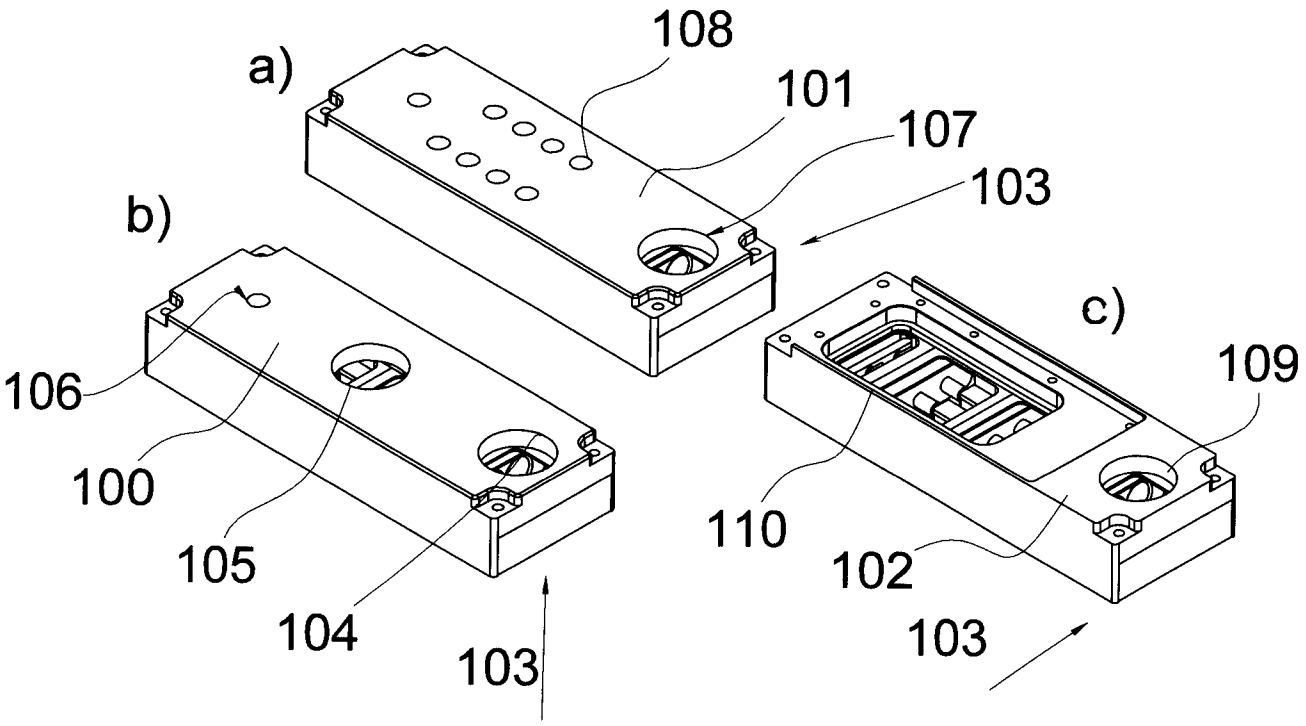
FIGS. 14 *a-c* show in schematic representation three alternative embodiments of a connecting plate disposed on a plate-shaped three-stage ejector.

In FIGS. 14 *a-c* are shown three examples of embodiments of a connecting plate 100,101,102, mounted on a plate-shaped multi-stage ejector 103 of rectangular cross section. FIG. 14 *a* shows a first connecting plate 100 comprising a compressed air outlet 104 for connection to, for example, a sound damper or a compressed air hose, a large vacuum port 105 and a small vacuum port 106 for vacuum detection for connection to an external unit.

FIG. 14 *b* shows a second connecting plate 101 comprising a compressed air outlet 107 for connection to, for example, a sound damper or a compressed air hose, nine small vacuum ports 108 for connection to various external units. FIG. 14 *c* shows a third connecting plate 102 comprising a compressed air outlet 109 for connection to, for example, a sound damper or a compressed air hose, and an open section 110 for connection to an external plate section comprising specially designed vacuum recesses.

Figure 15:
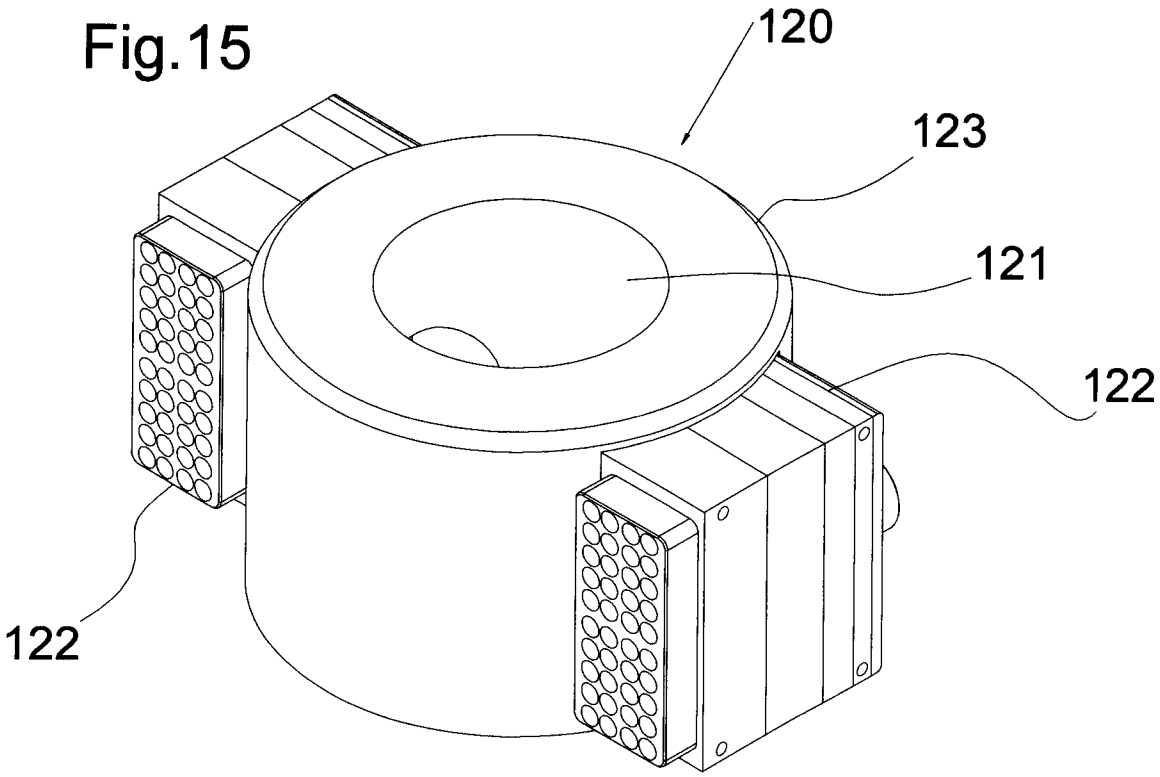
FIG. 15 shows in schematic representation a plate-shaped ejector comprising stacked multi-stage ejectors connected to a pipeline via a tubular connecting plate for generation of vacuum.

FIG. 15 shows a side view of an ejector device comprising at least two plate-shaped multi-stage ejectors 120, of the type shown in FIG. 14, mounted on a pipeline 121 for generation of vacuum. The multi-stage ejectors 120 are arranged in stacks one upon the other and form two ejector packs 122 mounted on the side of the pipeline 121 via a tubular connecting plate 123. The vacuum ports of the multi-stage ejectors are connected to the inner side of the pipeline 121 via hollow feed-throughs in the pipe wall.

The invention is not limited to shown embodiments, but can be varied in different ways within the scope of the patent claims.

The invention claimed is:

1. A multi-stage ejector for producing vacuums in an industrial process, comprising at least two ejector units axially arranged at a defined distance apart, wherein each of the at least two ejector units comprise at least two parallelly arranged hollow feed-throughs for compressed air, each of the hollow feed-throughs for compressed air extending parallel to a longitudinal axis of the at least two ejector units, each of the hollow feed-throughs for compressed air comprising respective inlet and outlet nozzles and being in direct fluid communication with at least one hollow feed-through for vacuum, wherein each of the at least two ejector units is configured as a part produced from one piece.

2. The multi-stage ejector as claimed in claim 1, wherein the ejector units are positionable in an ejector housing via longitudinal grooves disposed on the outer side of the ejector units and via corresponding longitudinal guide rails disposed on an inner side of the ejector housing.

3. The multi-stage ejector as claimed in claim 2, wherein the ejector units are lockable via spring-pretensioned guide lugs on the inner side of the ejector housing and via corresponding recesses on the outer side of the ejector units.

4. The multi-stage ejector as claimed in claim 2, wherein the ejector housing is configured as an open cylinder.

5. A multi-stage ejector for producing vacuums in an industrial process, comprising at least two ejector units axially arranged at a defined distance apart in an ejector housing, wherein each of the at least two ejector units comprises at least two parallelly arranged hollow feed-throughs for compressed air, comprising inlet and outlet nozzles and at least one hollow feed-through for vacuum, wherein each of the at least two ejector units is configured as a part produced from one, piece, wherein the at least, two ejector units comprise a sleeve coupling for connection to incoming and outgoing compressed air respectively, wherein the sleeve coupling comprises an outer sleeve, in which is mounted an inner sleeve, comprising a mounting seat for possible mounting of a nonreturn valve and a filter.

6. Multi-stage ejector as claimed in claim 5, wherein the sleeve coupling comprises transverse spring-loaded locking pins for locking the sleeve coupling to the respective ejector unit.

* * * * *